US006386888B1

(12) United States Patent
Skopic et al.

(10) Patent No.: US 6,386,888 B1
(45) Date of Patent: May 14, 2002

(54) MODULAR CONNECTOR

(75) Inventors: Albert Skopic; Donald Burger, both of York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/634,200

(22) Filed: Aug. 9, 2000

Related U.S. Application Data

(60) Provisional application No. 60/157,694, filed on Oct. 4, 1999.

(51) Int. Cl.[7] ..... H01R 9/05

(52) U.S. Cl. ..... 439/63; 439/581; 439/675

(58) Field of Search ..... 439/63, 581, 675, 439/607

(56) References Cited

U.S. PATENT DOCUMENTS

| | | | | |
|---|---|---|---|---|
| 4,541,683 A | | 9/1985 | Van Domelen | 439/551 |
| 5,108,300 A | * | 4/1992 | Weber | 4739/188 |
| 5,145,412 A | | 9/1992 | Tan et al. | 439/620 |
| 5,326,280 A | | 7/1994 | Briones et al. | 439/581 |

* cited by examiner

*Primary Examiner*—Brian Sircus
*Assistant Examiner*—Michael C. Zarroli
(74) *Attorney, Agent, or Firm*—William H. McNeill

(57) ABSTRACT

A modular connector is provided that includes a plurality of modular components that are connectable together. Such components or modules include a conductive bracket that may be grounded, a cover attachable to the bracket, a conductive insert that is extendable through the bracket and into the cover, an insulator that is extendable into the insert, and a contact that is insertable into the insulator to insulate the contact from the insert. The insert engages the bracket and is therefore grounded when the bracket is grounded.

23 Claims, 6 Drawing Sheets

MODULAR CONNECTOR

This application claims the benefit of U.S. Provisional Application No. 60/157,694, filed Oct. 4, 1999.

TECHNICAL FIELD

The present invention relates to a modular connector that includes at least one plurality of modular components connectable together. The modular nature of the modular connector of the present invention provides a manner in that various mounting configurations may be provided using many of the same basic components. The modular connector of the present inventor is particularly useful in circuits wherein a coaxial cable is connected to a printed circuit board.

BACKGROUND ART

The use of electrical connectors is common in many industries. One example is the various electrical connectors used throughout the wiring system of an automobile wiring system. For example, in such a system it is often desirable to connect a coaxial cable to the circuitry of a printed circuit board. In such instances, an electrical connector typically provides the interface between the two. When multiple design configurations are present, a different type of electrical connector may be required for each design. For example, different automotive electrical systems may require connectors having different housings, insulators and the like. Typically, this problem is solved by providing a variety of types and configurations of electrical connectors. In addition, when a new automotive feature is implemented, it may be necessary to also design and produce a completely new type of electrical connector. For example, there might be a need for a different mounting style or a new type of connector with multiple connections. In such instances, retooling may be required to fabricate the new part. Even in those cases where only one component of the electrical connector requires changing, retooling may still be required. For example, current electrical connectors often include a plastic body or a metal shell that are dedicated to a single design. Each of these is considered a major component of an electrical connector, and any change thereof involves retooling each time a new connector style is required.

DISCLOSURE OF THE INVENTION

It is an object of the present invention to provide an improved electrical connector.

Another object of the present invention is to obviate the disadvantages of the prior art.

A further object of the present invention is to provide a modular connector that may be readily modified for use with various design configurations.

Yet another object of the present invention is to provide a modular connector that may be fabricated from various interchangeable components to alter the configuration of the connector.

Another object of the present invention is to provide a modular connector that includes modular components that may be readily assembled.

It is a further object of the present invention to provide a modular connector useful as an interface between a coaxial cable and a printed circuit board.

Yet another object of the present invention is to provide a modular connector that achieves one or more of the foregoing objects and is useful in an automobile wiring system.

This invention achieves these and other objects by providing a modular connector, including at least one plurality of modules connectable together. Each plurality of modules includes a first module in the form of a bracket having at least one aperture extending therethrough, and a second module in the form of a cover having an opening extending therethrough. The bracket and the cover are structured and arranged for attachment of the cover to the bracket such that the aperture is adjacent the opening. A third module is provided in the form of an insert having a first bore extending therethrough. The insert is structured and arranged for insertion through the aperture and into the opening. A fourth module is provided in the form of an insulator having a second bore extending therethrough. The insulator is structured and arranged for insertion into the first bore. A fifth module is provided in the form of a contact structured and arranged for insertion into the second bore. Fabrication of the various components of the modular connector of the present invention may be accomplished using conventional procedures.

A modular connector may be provided comprising at least one plurality of modules that are connectable together and that includes a first module in the form of a conductive bracket. The bracket includes a wall having at least one aperture extending therethrough in the direction of a first axis from a first wall surface to an opposite second wall surface. A second module is provided in the form of an insulative cover having a base that includes an opening extending therethrough in the direction of a second axis from a first base surface to an opposite second base surface. A first tubular wall is provided that extends from the second base surface in the direction of a third axis coincident with the second axis. The first module and the second module are structured and arranged for attachment of the first base surface to the first wall surface such that the first axis is coincident with the second axis. A third module is provided in the form of a conductive insert that includes a second tubular wall having a flanged end. The second tubular wall extends in the direction of a fourth axis. The third module is structured and arranged (a) for insertion of the second tubular wall through the aperture and into a bore formed by the first tubular wall such that the first, second, third and fourth axes are coincident, and (b) for engagement of the flanged end with the second wall surface. A fourth module is provided in the form of an insulator that includes a third tubular wall extending from a bottom portion in the direction of a fifth axis. The fourth module is structured and arranged (a) for insertion of the third tubular wall into a bore formed by the second tubular wall such that the first, second, third, fourth and fifth axes are coincident, and (b) for engagement of the bottom portion with the second wall surface. A fifth module is provided in the form of a contact structured and arranged for insertion into a bore formed by the third tubular wall. The contact includes at least a portion that is coincident with the first, second, third, fourth and fifth axes.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

Figure 1:
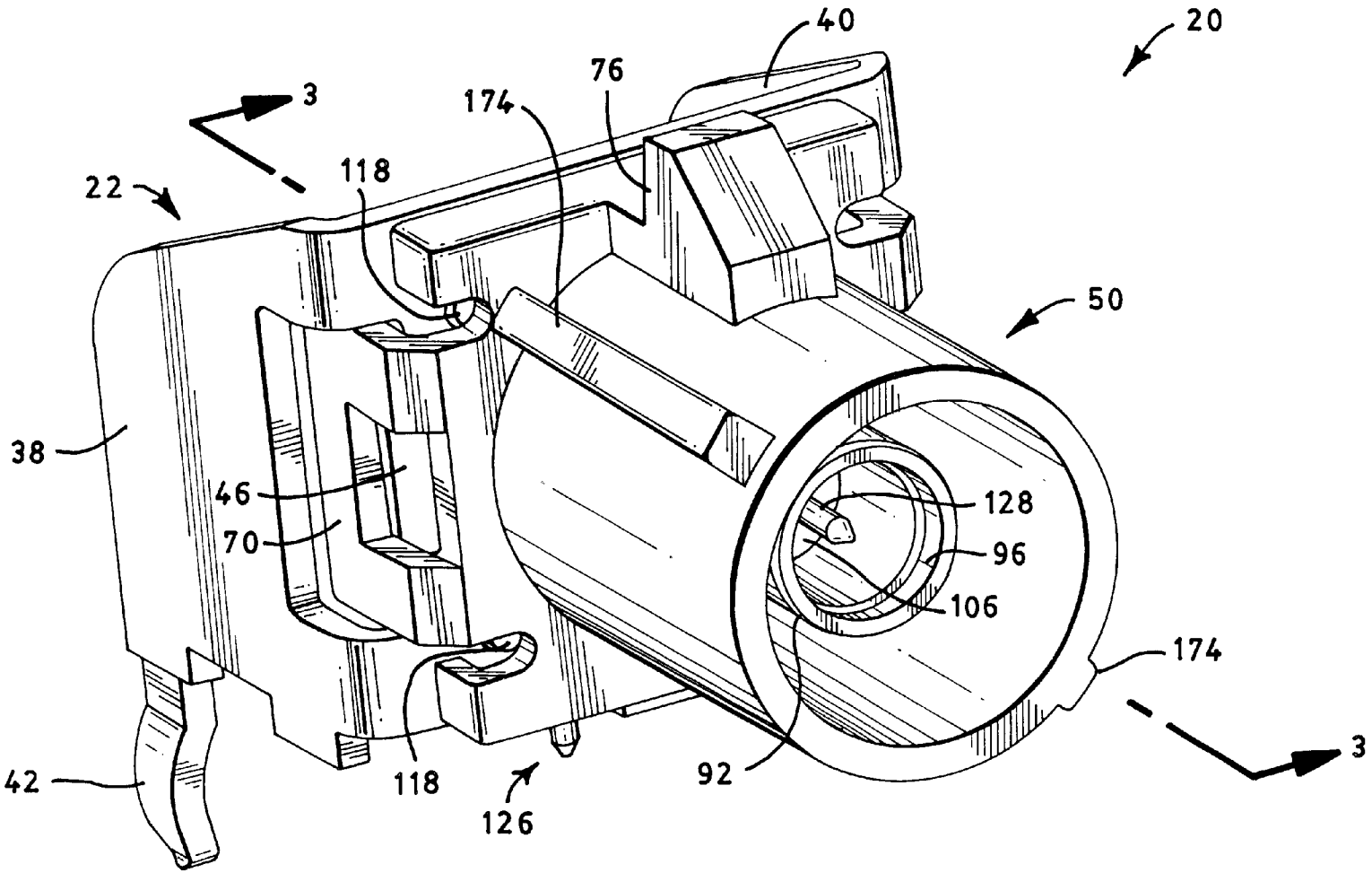
FIG. 1 is a perspective view of one embodiment of the modular connector of the present invention.

For a better understanding of the present invention, together with other and further objects, advantages and capabilities thereof, reference is made to the following disclosure and appended claims taken in conjunction with the above-described drawings.

In one embodiment of the present invention, a modular connector is provided that includes at least one plurality of modules connectable together. Each plurality of modules includes a first module in the form of a bracket having at least one aperture extending therethrough. For example, in the embodiment illustrated in FIGS. 1 to 3, a modular connector 20 is provided that includes a first module in the form of a conductive U-shaped bracket 22. Bracket 22 may be fabricated from metal. Bracket 22 comprise a wall 24 having at least one aperture 26 extending therethrough in the direction 28 of a first axis 30 from a wall surface 32 to an opposite wall surface 34. Wall 24 comprises a plurality of holes extending therethrough. For example, wall 24 comprises four holes 36 extending in direction 28 from wall surface 32 to wall surface 34. Walls 38 and 40 extend from the wall 24 and include respective terminals 42 and 44 that may provide ground terminals as described herein. In the embodiment illustrated in FIGS. 1 to 3, there are two terminals 42 and 44 although more or less terminals may be provided. Terminals 42 and 44 are oriented at about ninety degrees relative to axis 30. Such embodiment allows the bracket 22 to be mounted to a printed circuit board that is parallel to axis 30. Some other terminal orientation may be provided if desired. For example, the terminals may be oriented parallel to axis 30 as illustrated schematically in phantom lines with respect to terminal 44 at 44' in FIG. 3. Such embodiment allows the bracket 22 to be mounted to a printed circuit board that is perpendicular to axis 30. The bracket of the present invention may comprise at least one latch the use of that will be described herein. For example bracket 22 includes two latches 46 and 48 that extend from wall 24 in direction 28. Each plurality of modules of the present invention comprises a second module in the form of a cover having an opening extending therethrough. The bracket and cover are structured and arranged for attachment of the cover to the bracket such that the bracket aperture is adjacent the cover opening. For example, in the embodiment illustrated in FIGS. 1 to 4, the modular connector 20 is provided with a second module in the form of an insulative cover 50. Cover 50 may be fabricated from plastic material. Cover 50 includes a base 52 having an opening 54 extending therethrough in the direction 56 of an axis 58 from a base surface 60 to an opposite base surface 62. Cover 50 includes a tubular wall 64 that extends in a direction 66 of a third axis 68 from base surface 62. Axes 58 and 68 are coincident as illustrated in FIG. 4. The cover of the present invention may comprise at least one latch. For example, cover 50 comprises two resilient latches 70, 72 extending from the base 52 in direction 56. The latches of the bracket and cover of the present invention are structured and arranged for attaching the cover to the bracket by latching together the latches of the cover and respective mating latches of the bracket. For example, in the embodiment illustrated in FIGS. 1 to 3, the cover 50 and bracket 22 are structured and arranged for latching latches 70, 72 with respective mating latches 46, 48 thereby attaching the base surface 60 of the base 52 to the wall surface 32 of the wall 24 such that the axis 30 is coincident with the axis 58. In particular, each mating latch 46, 48 urges a respective resilient latch 70, 72 apart as the cover 50 is being attached to the bracket 22. When attachment is complete, latches 70, 72 resile towards each other to engage respective mating latches 46,48. The cover 50 may include a plurality of recesses therein. For example, in the embodiment illustrated in FIGS. 1 to 4, the cover 50 comprises four recesses 74, one at each of the corners of base surface 60. Recesses 74 extend in direction 56 of axis 58 into the base surface 60 of the base 62. When the cover 50 is attached to the bracket 22 using latches 70, 72 and respective mating latches 46, 48, the recesses 74 of cover 50 will be aligned with respective holes 36 of bracket 22. The cover of the present invention may comprise at least one mounting tab for use in attaching the cover to a support surface. For example, cover 50 comprises one mounting tab 76 that is structured and arranged for attachment of the cover to a support member 78. Tab 76 includes a ramp 80 that may be inserted through opening 82 of the support member 78 in a conventional manner until the support member extends into recess 84, as illustrated in FIG. 3. When assembled in this manner, the base surface 62 and an abutment surface 86 of the support member 78 engage opposite sides 88 and 90 of the support member to hold the cover 50 in place relative to the support member. Cover 50 may comprise other types of mounting tabs structured and arranged for attachment of the cover to other types of support members, mounting tab 76 being by way of example.

Each plurality of modules of the present invention comprises a third module in the form of an insert having a bore extending therethrough. Such insert is structured and arranged for insertion through the aperture of the bracket and into the opening of the cover. For example, in the embodiment illustrated in FIGS. 1 to 3, the modular connector 20 is provided with a third module in the form of a conductive insert 92. Insert 92 may be fabricated from metal. Insert 92 includes a tubular wall 94 forming a bore 96 and having a flanged end 98. Tubular wall 94 extends in the direction 100 of an axis 102 and is structured and arranged to be inserted through aperture 26 of wall 24 of the bracket 22 and into the opening 54 of the base 52 of the cover 50 when the modulator connector 20 is being assembled. In the embodiment illustrated in FIGS. 1 to 3, the tubular wall 94 is extended into opening 54 and the bore 104 formed by the tubular wall 64 of the cover 50 during assembly of the modulator connector 20. In particular, the tubular wall 94 is inserted into the bore 104 until the flanged end 98 engages the wall surface 34 of the bracket 22. When assembled in this manner, axes 30, 58, 68 and 102 will be coincident. When the terminals 42, 44 of the conductive bracket 22 are electrically connected to a ground circuit, engagement of the flanged end 98 of the conductive insert 92 with the wall surface 34 of the conductive bracket 22 will effect an electrical connection thereby grounding the insert.

Each plurality of modules of the present invention comprises a fourth module in the form of an insulator having a bore extending therethrough. Such insulator is structured and arranged for insertion into the bore of the insert of the present invention in assembling the modular connector 20. For example, in the embodiment illustrated in FIGS. 1 to 3, the modular connector 20 is provided with a fourth module in the form of an insulator 106. Insulator 106 may be fabricated from plastic material. Insulator 106 includes a tubular wall 108 extending from a bottom portion 110 in the direction 112 of a fifth axis 114. Tubular wall 108 forms a bore 116. Insulator 106 is structured and arranged for insertion of the tubular wall 108 in the bore 96 until the bottom portion 110 engages the wall surface 34 of the wall 24 of the bracket 22 when assembling modular connector 20. When assembled in this manner, axes 30, 58, 68, 102 and 114 will be coincident. The insulator 106 may comprise a plurality protuberances extending therefrom. For example, the insulator 106 comprises four protuberances 118 extending in direction 112 from the bottom portion 110. The protuberances 118 are positioned such that when the tubular wall 108 is inserted in the bore 96 and the bottom portion 110 engages the wall surface 34 of the wall 24 of the bracket 22, each protuberance will extend through a respective hole 36 of bracket 22 and into a respective recess 74 of the cover 50 for attachment of the insulator 106 to the cover. To this end, each protuberance 118 may be bonded to the base surface 60 in a conventional manner.

The insulator of the present invention may include an abutment surface structured and arranged to mate with the insert of the present invention when the insulator is inserted into the bore provided by the insert. For example, in the embodiment illustrated in FIGS. 1 to 3, the bottom portion 110 includes a cavity 120 extending into a surface 122 to a base 124. Cavity 120 is configured such that it mates with, and its base 124 engages, the flanged end 98 when the tubular wall 108 is inserted into the bore 96 and the bottom portion 110 engages the wall surface 34 of the wall 24 of the bracket 22.

Each plurality of modules of the present invention comprise a fifth module in the form of a contact structured and arranged for insertion into the bore formed by the insulator. For example, in the embodiment illustrated in FIGS. 1 to 3, the modular connector 20 is provided with a fifth module in the form of an elongated rod-like metal male contact 126 at least an elongated portion 126' of that is inserted into the bore 116 of insulator 106 during the assembling of the modular connector 20. As illustrated in FIG. 1, in this embodiment a distal length 128 of the contact 126 extends into the bore 96 of the insert 92. When assembled in this manner, the portion 126' of the contact 126 will be coincident with the axes 30, 58, 68, 102 and 114 when the plurality of modules of the modular connector 20 are assembled together. In the embodiment illustrated in FIGS. 1 to 3, a leg 130 of the contact 126 is parallel to the terminals 42 and 44. Such embodiment allows through hole mounting of the leg 130 to the circuit of a printed circuit board that is parallel to axis 30. Alternatively, leg 130 may be provided with a leg portion 130' illustrated in FIG. 3 in phantom lines that is perpendicular to terminals 42 and 44. Such embodiment allows surface mounting of the leg portion 130' to such circuit board. Other contact orientation may be provided if desired. For example, leg 130 may be replaced with a leg 130" that is oriented perpendicular to terminals 42 and 44 as illustrated in phantom lines in FIG. 3. Such embodiment allows through hole mounting of the leg 130" to a printed circuit board that is perpendicular to axis 30.

Figure 2:
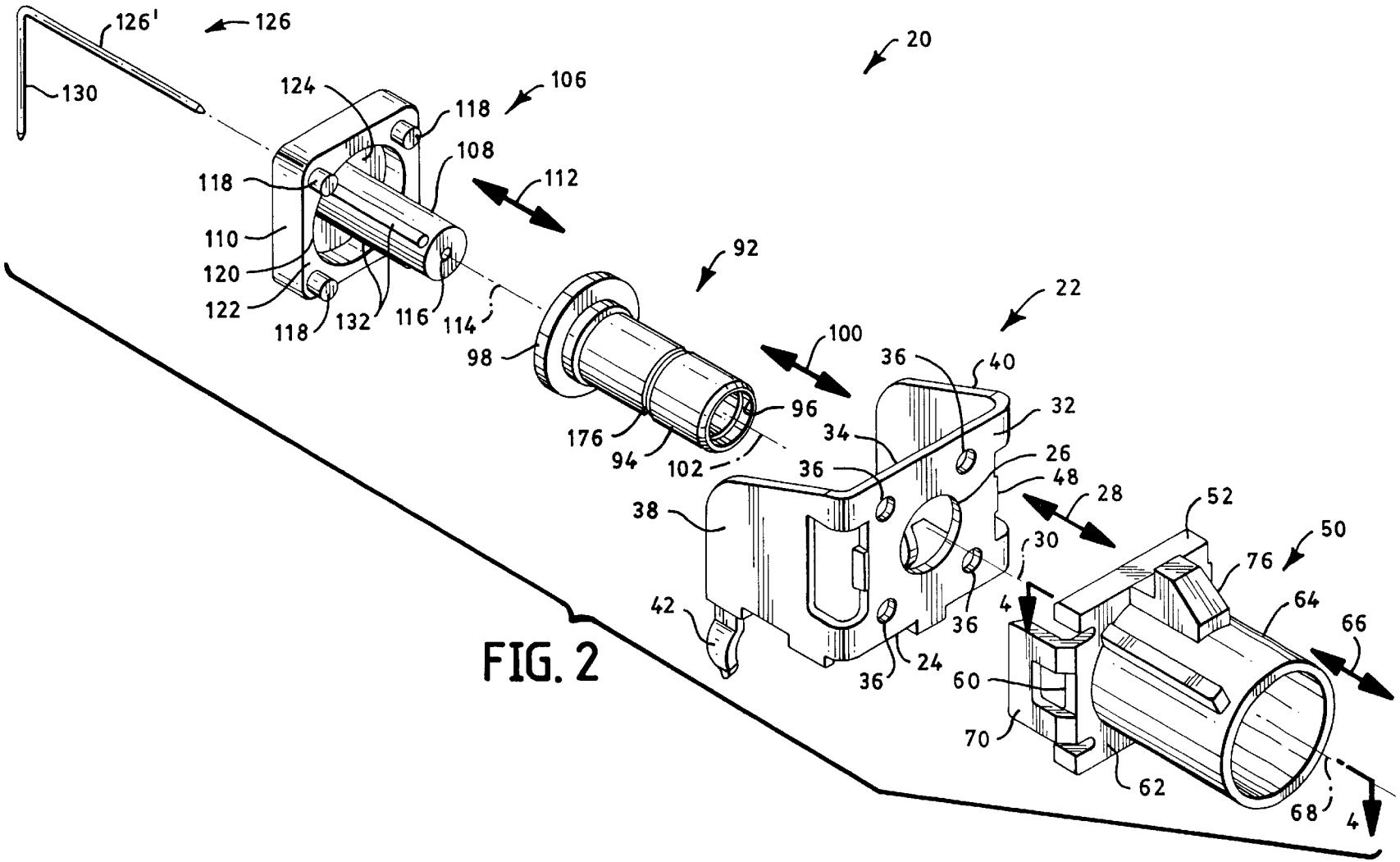
FIG. 2 is a perspective exploded view of FIG. 1.
Figure 3:
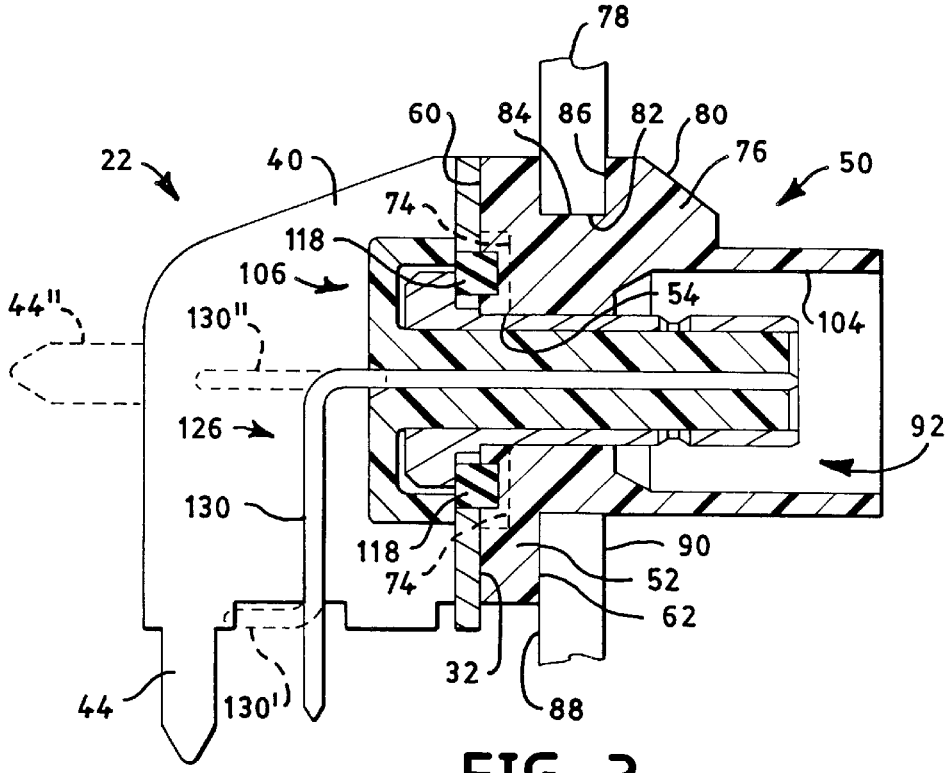
FIG. 3 is a cross sectional view of the assembled modular connector of FIG. 1 taken along lines 3—3.
Figure 4:
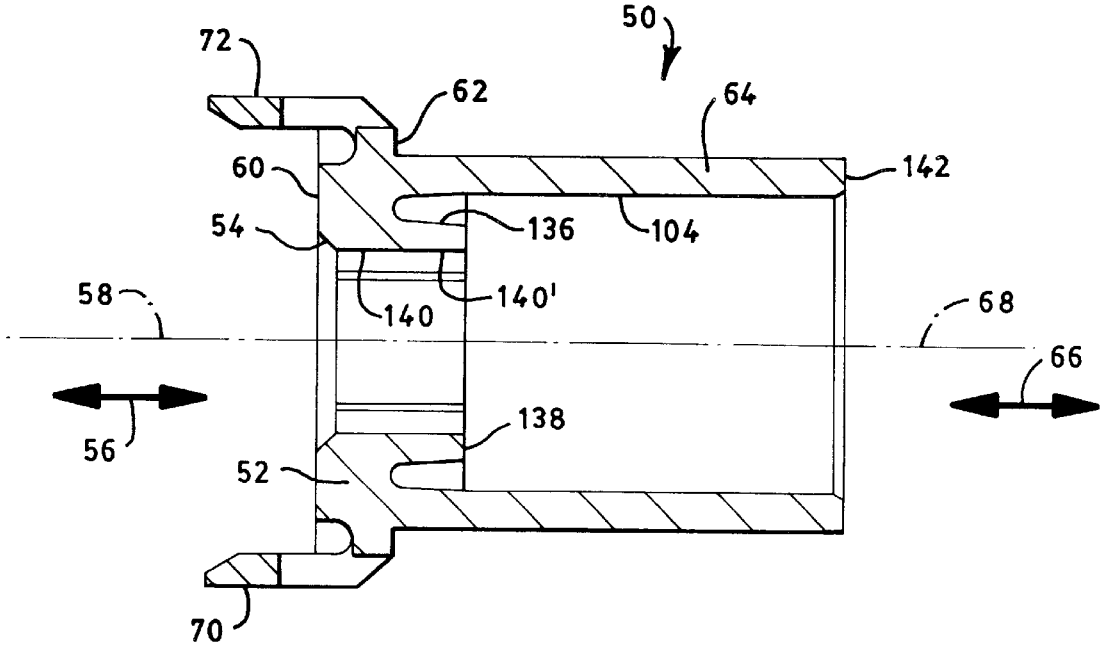
FIG. 4 is a cross sectional view of the cover of FIG. 2 taken along lines 4—4.

In the embodiment illustrated in FIGS. 1 to 3, the tubular wall 108 of the insulator 106 may include a plurality of elongated ribs 132 that are circumferentially spaced and extend in direction 112. Without limitation, in the embodiment illustrated in FIGS. 1 and 2, there are four equally spaced ribs 132 only two of that are visible in FIG. 2. Ribs 132 and bore 96 of the insert 92 may be structured and arranged such that each rib will engage the inner surface that forms bore 96 to center the tubular wall 108 within the bore 96 and/or provide a force fit thereby holding the insulator in place relative to the insert.

In the embodiment illustrated in FIGS. 1 to 3, the tubular wall 64 of the cover 50 forms a sleeve. With reference to FIG. 4, another sleeve 136 is provided that is adjacent the opening 54 of the base 52 of the cover 50. Sleeve 136 extends within and is concentric with the sleeve formed by tubular wall 64. Sleeve 136 extends from the base surface 62 to a sleeve end 138. When the tubular wall 94 of the insert 92 is inserted into the opening 54, the tubular wall 94 is extended through and engages the inner surface 140 of the opening 54 and the inner surface 140' of the sleeve 136 to facilitate centering and/or force fit of the tubular wall 94 relative to the bore 104. Sleeve end 138 is positioned between the base surface 62 and an opposite distal end 142 of the sleeve formed by tubular wall 64.

Figure 5:
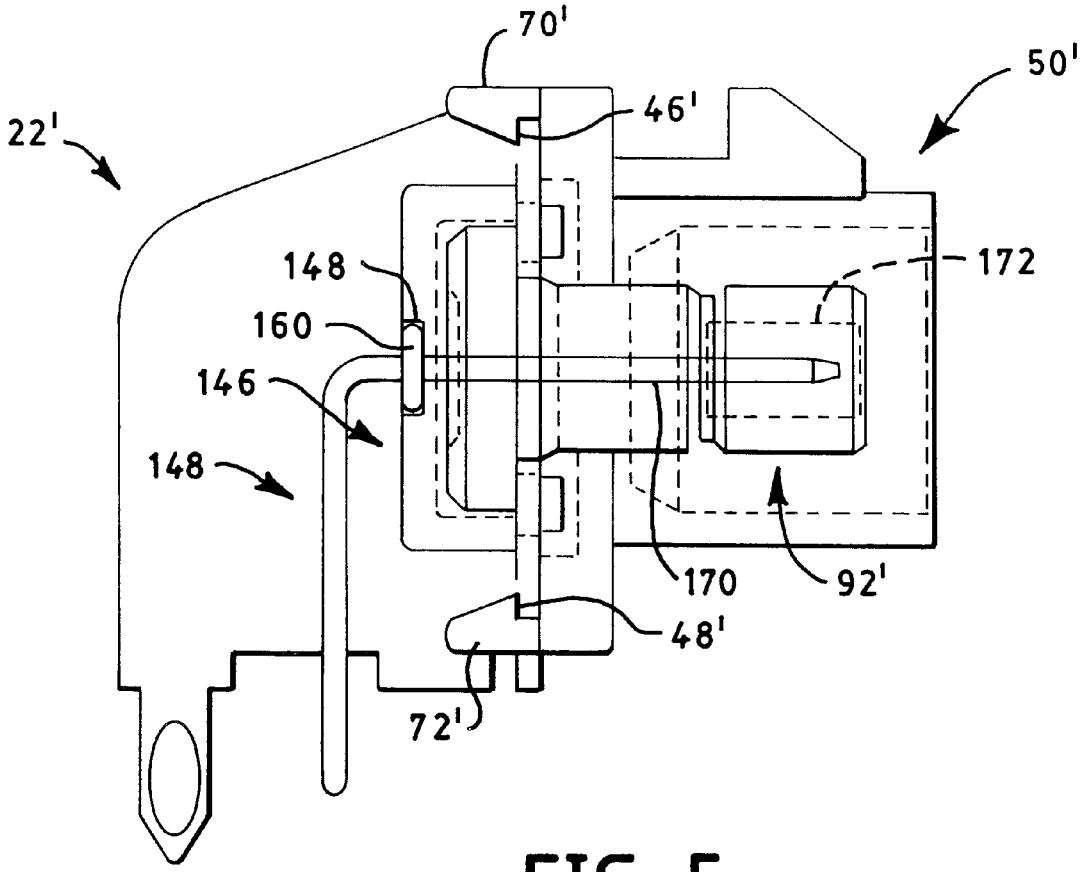
FIG. 5 is a cross sectional view of an alternative embodiment similar to the cross sectional view of FIG. 3.

In an alternative embodiment of the insulator of the present invention, an insulator may be provided that includes an abutment surface, and a contact may be provided that includes another abutment surface. Such abutment surfaces may be structured and arranged to engage each other when the contact is inserted into the bore of the insulator to limit the extent of such insertion. For example, in the alternative embodiment illustrated in FIGS. 5 and 6, the bottom portion 144 of an insulator 146, that may be used in place of insulator 106, includes a cavity 148 that extends in direction 150 of axis 152 into the surface 154 to a cavity base surface 156. In such embodiment, a contact 148, that may be used in place of contact 126, includes a flanged area 160 positioned between contact end 162 and an opposite contact end 164. The flanged area 160 is structured and arranged to extend into the cavity 148 such that the flanged area engages the cavity base surface 156 when the contact 148 is inserted into the bore 166 of the tubular wall 168 of insulator 146.

Figure 6:
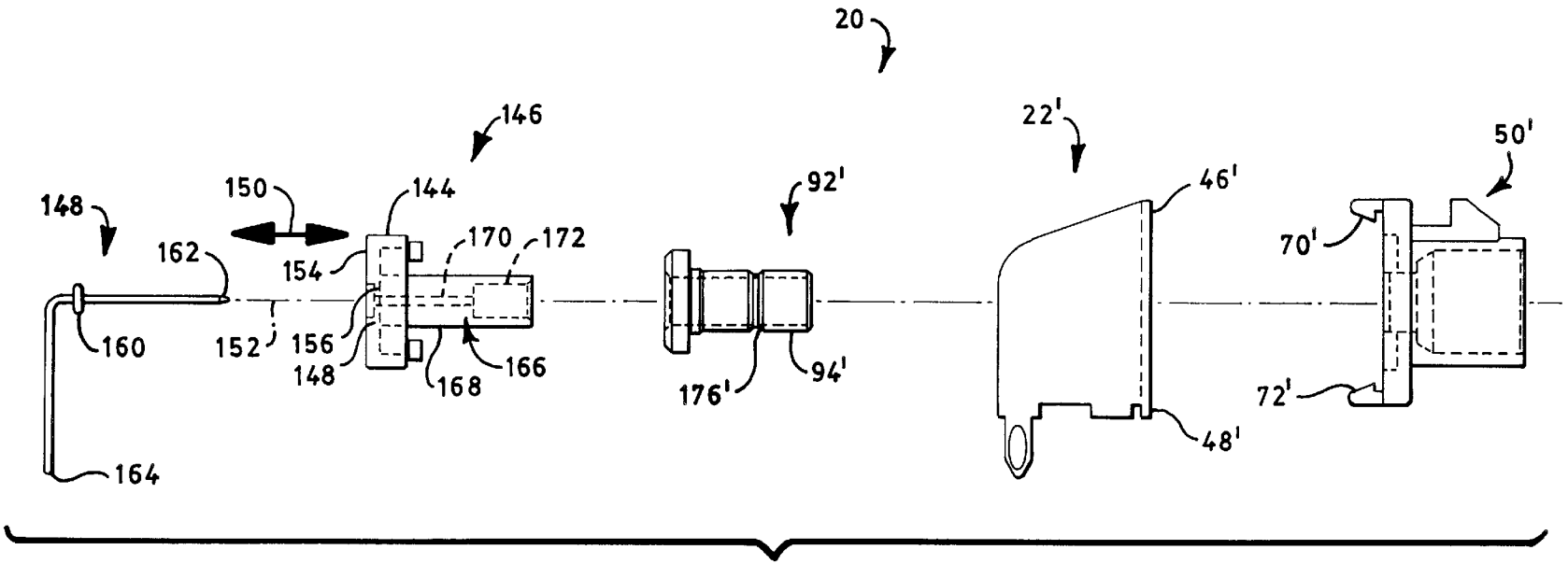
FIG. 6 is a perspective exploded view of FIG. 5.

The insulator of the present invention may be further altered by providing an insulator that includes a first length and a second length extending from the first length, the insulator bore extending through the first length and into the second length. In such embodiment, the insulator bore includes a first bore segment that extends through such first length and a second bore segment that extends through the second length. The diameter of the first bore segment is less than the diameter of the second bore segment. In such embodiment, the contact includes a portion that extends through the first bore segment and into the second bore segment. For example, in the embodiment illustrated in FIGS. 5 and 6, the tubular wall 168 of insulator 146 includes a first length extending from the bottom portion 144, and a second length that extends from the first length to the end of the insulator. The bore 166 includes a first bore segment 170 extending through the first length and a second bore segment 172 extending through the second length 172. The diameter of bore segment 170 is less than the diameter of bore segment 172. The portion of the contact 148 extending from the flanged area 160 to the contact end 162 extends through the first bore segment 170 and into the second bore segment 172 as illustrated in FIG. 6. Although not necessary, in the embodiment illustrated in FIGS. 5 and 6, latches 46, 48 may be replaced with latches 46', 48', and latches 70, 72 may be replaced with latches 70', 72'. Latches 70', 72' engage respective mating latches 46', 48' when the cover 50' is attached to the bracket 22'. Except as described herein, bracket 22', cover 50', insert 92', insulator 146 and pin 148 may otherwise be structured and function the same as corresponding modules of the embodiment of FIGS. 1 to 4.

In the embodiment illustrated in FIGS. 1 to 3, the outer surface of the cover 50 includes two elongated ribs 174.

More or less ribs, including no ribs, may be provided if desired. Such ribs are provided to assure that the cover 50 may be properly aligned with the support member 78 when attached thereto using mounting tab 76. To this end, the two elongated ribs 174 are aligned with and extend within two respective mating slots (not shown) of the support member 78 when the cover 50 is attached thereto. In the embodiment illustrated in FIGS. 1 to 3, the two ribs 174 are circumferentially spaced 180 degrees. Such spacing may vary as desired. Regardless of the positioning of the ribs 174 each cover design will be interchangeable to the extent that it may be assembled with the remaining modules that form the modular connector 20. In other words, a variety of interchangeable covers may be provided that are identical to cover 50 with the exception that different configurations of ribs 174 may be provided to accommodate mounting design variations.

In the specific examples discussed above, a single contact is provided that is illustrated as a rod or pin 126, 148 that forms a male type of electrical connector. In such embodiment, the outer surface of the tubular wall 94, 94' of the insert 92, 92' may include a circumferentially extending groove 176, 176'. When a female connector is electrically and mechanically connected to the connector module 20, 20' of the present invention, the pin-like male contact 126, 148 will be inserted into the conventional ferrule of the female contact, and the shell of the female contact will mate with the groove 176, 176' in a conventional manner.

Figure 7:
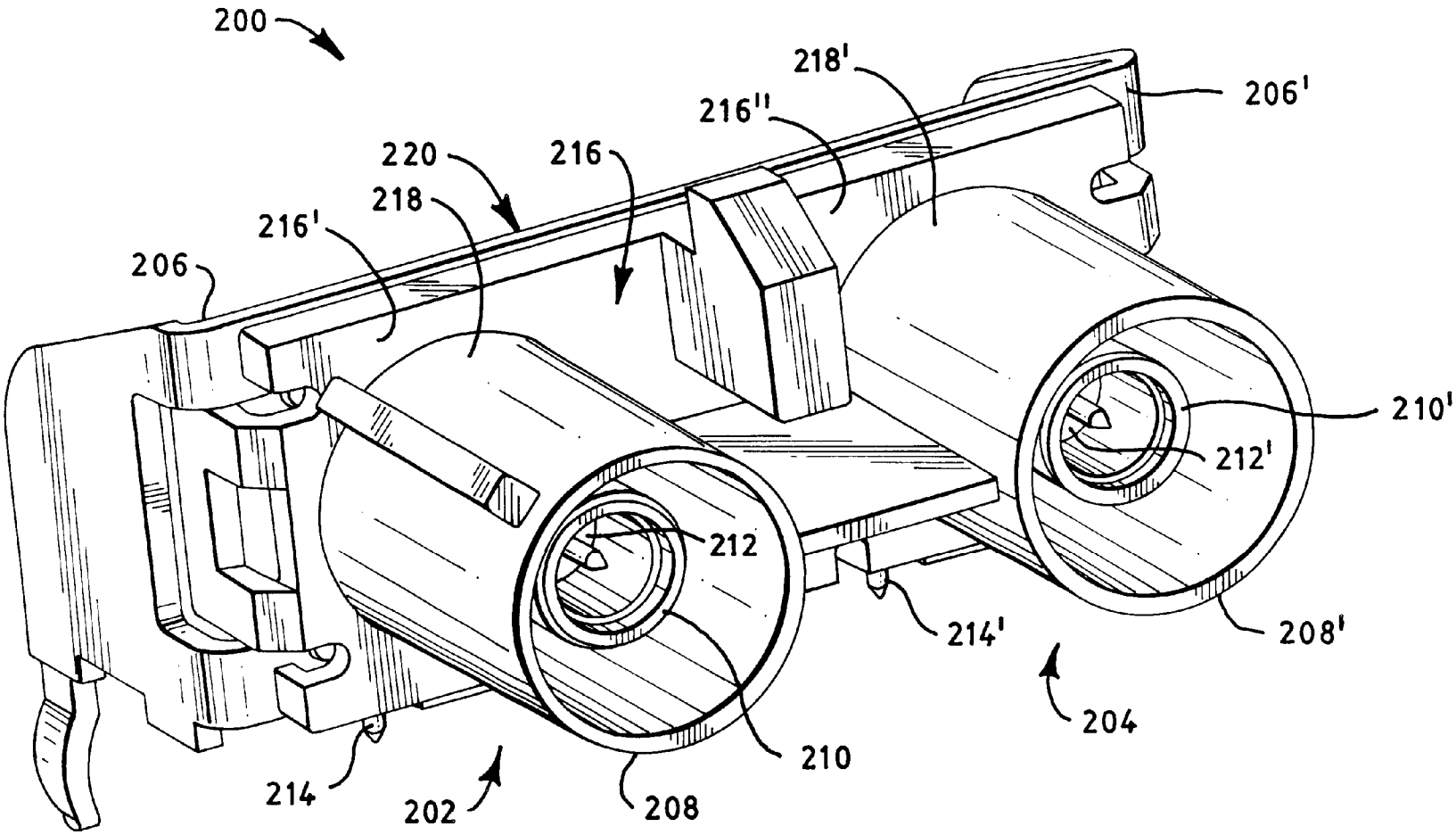
FIG. 7 is a perspective view of another embodiment of the modular connector of the present invention.

In the specific embodiments of the present invention discussed above and illustrated in FIGS. 1 to 6, the modular connector of the present invention is illustrated as including only one plurality of modules connectable together, such modular connector having a single contact. It will be readily apparent to those skilled in the art that more than one plurality of modules may be provided if it is desired to have a modular connector having more than one contact. For example, FIG. 7 illustrates one example of a modular connector 200 that comprises a first plurality of modules 202 and a second plurality of modules 204. In such embodiment, each plurality of modules includes a first module in the form of bracket 206, 206', second modules in the form of covers 208, 208', third modules in the form of inserts 210, 210', fourth modules in the form of insulators 212, 212', and fifth modules in the form of contacts 214, 214'. It will be noted that in the embodiment illustrated in FIG. 7, covers 208, 208' extend from a common base 216 from that respective tubular walls 218, 218' extend. Alternatively, common base 216 may be in the form of two separate bases generally designated 216', 216" (not shown as separate bases) that may be attached to the brackets 206, 206', a respective tubular wall 218, 218' extending from a respective base. Similarly, the brackets 206, 206' form a common bracket 220 to that the common base 216 is attached, or to that separate bases 216', 216" may be attached if a common base 216 is not provided. Otherwise, the features discussed above relating to the plurality of modules that form the modular connector 20 may be the same as those of each of the plurality of modules 202 and 204.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

We claim:

1. A modular connector, comprising at least a first plurality of modules connectable together, each plurality of modules comprising:

a first module in the form of a bracket having at least one aperture extending therethrough;

a second module in the form of a cover having an opening extending therethrough, said bracket and said cover being structured and arranged for attachment of said cover to said bracket such that said aperture is adjacent said opening;

a third module in the form of an insert having a first bore extending therethrough, said insert being structured and arranged for insertion through said aperture and into said opening;

a fourth module in the form of an insulator having a second bore extending therethrough, said insulator being structured and arranged for insertion into said first bore; and wherein said insulator comprises a plurality of protuberances, said bracket comprises a plurality of holes extending therethrough, and said cover comprises a plurality of recesses therein, said plurality of modules being structured and arranged such that each of said plurality of protuberances is extendable through a respective hole of said plurality of holes and insertable into a respective recess of said plurality of recesses for attachment of said insulator to said cover, and a fifth module in the form of a contact structured and arranged for insertion into said second bore.

2. The modular connector of claim 1 wherein said cover comprises at least one latch and said bracket comprises at least one mating latch, said latch and mating latch being structured and arranged for attaching said cover to said bracket by latching said latch to said mating latch.

3. The modular connector of claim 1 wherein said cover comprises at least one mounting tab structured and arranged for attachment of said cover to a support member.

4. The modular connector of claim 1 wherein said insert and said bracket are each a conductive material, and said bracket comprises at least one ground terminal, and further wherein said insert is electrically connectable to said bracket.

5. The modular connector of claim 3 wherein said cover comprises at least one mounting tab structured and arranged for attachment of said cover to a support member.

6. The modular connector of claim 5 wherein said insert and said bracket are each a conductive material, and said bracket comprises at least one ground terminal, and further wherein said insert is electrically connectable to said bracket.

7. The modular connector of claim 1 wherein said insulator comprises a first abutment surface structured and arranged to mate with said insert when said insulator is inserted into said first bore.

8. The modular connector of claim 1 wherein said insulator comprises a second abutment surface and said contact comprises a third abutment surface, said second and third abutment surfaces being structured and arranged so that said second abutment surface engages said third abutment surface when said contact is inserted into said second bore.

9. The modular connector of claim 1 wherein said insulator comprises a first length and a second length extending from said first length, and further wherein said second bore comprises a first bore segment extending through said first length and a second bore segment extending through said second length, the diameter of said first bore segment being less than the diameter of said second bore segment, said contact having a portion extendable through said first bore segment and into said second bore segment.

10. The modulator connector of claim 1 wherein said cover comprises a first sleeve and a second sleeve, said first sleeve being adjacent said opening and extending within and being concentric with said second sleeve, and further wherein said conductive insert is extendable through and engagable with said first sleeve.

11. The modulator connector of claim 1 wherein said insulator comprises at least one rib structured and arranged to engage a surface forming said first bore when said insulator is inserted into said first bore.

12. A modular connector, comprising at least a first plurality of modules connectable together, each plurality of modules comprising:

a first module in the form of a conductive bracket comprising a first wall having at least one aperture extending therethrough in the direction of a first axis from a first wall surface to an opposite second wall surface;

a second module in the form of an insulative cover comprising a base having an opening extending therethrough in the direction of a second axis from a first base surface to an opposite second base surface, and a first tubular wall extending from said second base surface, said first tubular wall extending in the direction of a third axis coincident with said second axis, said first module and said second module being structured and arranged for attachment of said first base surface to said first wall surface such that said first axis is coincident with said second axis;

a third module in the form of a conductive insert comprising a second tubular wall having a flanged end and extending in the direction of a fourth axis, said third module being structured and arranged (a) for insertion of said second tubular wall through said aperture and into a bore formed by said first tubular wall such that said first, second, third and fourth axes are coincident, and (b) for engagement of said flanged end with said second wall surface;

a fourth module in the form of an insulator comprising a third tubular wall extending from a bottom portion in the direction of a fifth axis, said fourth module being structured and arranged (a) for insertion of said third tubular wall into a bore formed by said second tubular wall such that said first, second, third, fourth and fifth axes are coincident, and (b) for engagement of said bottom portion with said second wall surface; and a fifth module in the form of a contact structured and arranged for insertion into a bore formed by said third tubular wall, said contact comprising at least a portion that is coincident with said first, second, third, fourth and fifth axes.

13. The modular connector of claim 12 wherein said bottom portion comprises a plurality of protuberances, that extend in the direction of said fifth axis, said first wall comprises a plurality of holes that extend therethrough in the direction of said first axis, and said first base surface comprises a plurality of recesses therein that extend in the direction of said second axis, said plurality of modules being structured and arranged such that each protuberance of said plurality of protuberances is extendable through a respective hole of said plurality of holes and insertable into a respective recess of said plurality of recesses for attachment of said insulator to said cover.

14. The modular connector of claim 13 wherein said base comprises at least one latch and said bracket comprises at least one mating latch, said latch and said mating latch being structured and arranged for attaching said cover to said bracket by latching said latch to said mating latch.

15. The modular connector of claim 12 wherein said bottom portion comprises a first cavity extending into a first surface to a first cavity base surface, said first cavity being structured and arranged to mate with said flanged end such that said first cavity base surface engages said flanged end when said third tubular wall is inserted into said bore formed by said second tubular wall and said bottom portion engages said second wall surface.

16. The modular connector of claim 12 wherein said bottom portion comprises a second cavity extending into an opposite second surface to a second cavity base surface, and farther wherein said contact comprises a flanged area between a first contact end and an opposite second contact end, said flanged area being structured and arranged to extend into said second cavity such that said flanged area engages said second cavity base surface when said contact is inserted into said bore formed by said third tubular wall.

17. The modular connector of claim 12 wherein said third tubular wall comprises a first length extending from said bottom portion, and a second length extending from said first length, and further wherein said bore formed by said third tubular wall comprises a first bore segment extending through said first length and a second bore segment extending through said second length, the diameter of said first bore segment being less than the diameter of said second bore segment, said portion of said contact being extendable through said first segment and into said second segment.

18. The modular connector of claim 12 wherein said cover comprises a sleeve adjacent said opening, said sleeve extending from said second base surface to a sleeve end, said sleeve extending within and being concentric with said first tubular wall, and said sleeve end being positioned between said base surface and an opposite distal end of said first tubular wall, and further wherein said second tubular wall is extendable through and matable with said sleeve.

19. The modular connector of claim 12 wherein an outer surface of said third tubular wall comprises at least one elongated rib extending in said direction of said fifth axis, said rib being structured and arranged to engage an inner surface of said second tubular wall when said third tubular wall is inserted into said bore formed by said second tubular wall.

20. The modular connector of claim 14 wherein said bottom portion comprises a first cavity extending into a first surface to a first cavity base surface, said first cavity being structured and arranged to mate with said flanged end such that said first cavity base surface engages said flanged end when said third tubular wall is inserted into said bore formed by said second tubular wall and said bottom portion engages said second wall surface.

21. The modular connector of claim 20 wherein said bottom portion comprises a second cavity extending into an opposite second surface to a second cavity base surface, and further wherein said contact comprises a flanged area between a first contact end and an opposite second contact end, said flanged area being structured and arranged to extend into said second cavity such that said flanged area engages said second cavity base surface when said contact is inserted into said bore formed by said third tubular wall.

22. The modular connector of claim 21 wherein said third tubular wall comprises a first length extending from said bottom portion, and a second length extending from said first length, and further wherein said bore formed by said third tubular wall comprises a first bore segment extending through said first length and a second bore segment extending through said second length, the diameter of said first bore segment being less than the diameter of said second bore segment, said portion of said contact being extendable through said first segment and into said second segment.

23. The modular connector of claim 22 wherein said cover comprises a sleeve adjacent said opening, said sleeve extending from said second base surface to a sleeve end, said sleeve extending within and being concentric with said first tubular wall, and said sleeve end being positioned between said base surface and an opposite distal end of said first tubular wall, and further wherein said second tubular wall is extendable through and matable with said sleeve.

* * * * *